US009677855B2

(12) United States Patent
VanErmen et al.

(10) Patent No.: US 9,677,855 B2
(45) Date of Patent: Jun. 13, 2017

(54) PROTECTIVE GLOVE WITH WIRE MESH

(71) Applicant: Performance Fabrics, Inc., Grand Rapids, MI (US)

(72) Inventors: Steven R. VanErmen, Grand Rapids, MI (US); Ronald D. Henion, Middleville, MI (US)

(73) Assignee: Performance Fabrics, Inc., Grand Rapids, MI (US)

( * ) Notice: Subject to any disclaimer, the term of this patent is extended or adjusted under 35 U.S.C. 154(b) by 838 days.

(21) Appl. No.: 14/039,369

(22) Filed: Sep. 27, 2013

(65) Prior Publication Data

US 2014/0173799 A1 Jun. 26, 2014

Related U.S. Application Data

(60) Provisional application No. 61/707,697, filed on Sep. 28, 2012, provisional application No. 61/785,465, filed on Mar. 14, 2013.

(51) Int. Cl.
*F41H 1/02* (2006.01)
*A41D 19/00* (2006.01)

(52) U.S. Cl.
CPC ..... *F41H 1/02* (2013.01); *A41D 19/0096* (2013.01)

(58) Field of Classification Search
CPC ... F41H 1/02; A41D 19/015; A41D 19/01511; A41D 19/01505
See application file for complete search history.

(56) References Cited

U.S. PATENT DOCUMENTS 3,916,448 A * 11/1975 Hamel ..... A41D 19/01505 2/16
4,004,295 A * 1/1977 Byrnes, Sr. ..... A41D 19/01511 2/16
4,094,014 A * 6/1978 Schroeder ..... A41D 19/01505 2/161.8
4,272,568 A * 6/1981 Berend ..... A41D 19/0062 427/261
4,833,733 A * 5/1989 Welch ..... A41D 19/0058 2/169
5,054,126 A * 10/1991 Rivkin ..... A41D 19/01511 2/16
5,231,700 A * 8/1993 Cutshall ..... A61B 42/00 2/161.7

(Continued)

FOREIGN PATENT DOCUMENTS

NO CA 2345052 A1 * 3/2000 ..... A41D 19/01511

*Primary Examiner* — Shaun R Hurley
*Assistant Examiner* — Andrew W Sutton
(74) *Attorney, Agent, or Firm* — Price Heneveld LLP

(57) ABSTRACT

A protective glove includes an inner liner having a soft pliable material configured to cover a front side and a back side of a user's hand. A protective layer is attached to an exterior surface of the inner liner and disposed over at least the front side of the user's hand. The protective layer includes a wire mesh panel that is configured to protect the user's hand from cuts, abrasions, and punctures and that has an edge portion with a plurality of wire ends. An edge protector is disposed over the edge portion of the wire mesh panel and substantially conceals the wire ends to prevent the edge portion from fraying and the plurality of wire ends from piercing the inner liner. An outer layer is attached to the exterior surface of the inner liner and is disposed over the protective layer.

17 Claims, 7 Drawing Sheets

(56) References Cited

U.S. PATENT DOCUMENTS

| | | | | |
|---|---|---|---|---|
| 5,511,241 | A * | 4/1996 | Ziegler | A41D 19/01511 2/16 |
| 5,745,919 | A * | 5/1998 | Kraatz | D02G 3/442 2/159 |
| 6,155,084 | A * | 12/2000 | Andrews | A41D 13/08 2/16 |
| 6,427,250 | B1 * | 8/2002 | Stull | A41D 19/01529 2/16 |
| 6,581,212 | B1 | 6/2003 | Andresen | |
| 2009/0271912 | A1 * | 11/2009 | Jaunault | A41F 1/06 2/160 |
| 2011/0179551 | A1 * | 7/2011 | VanErmen | A41D 19/01558 2/161.6 |
| 2013/0139294 | A1 * | 6/2013 | Zetune | A41D 19/01505 2/163 |
| 2013/0213094 | A1 * | 8/2013 | Moreland | D04B 1/28 66/174 |

* cited by examiner

PROTECTIVE GLOVE WITH WIRE MESH

CROSS-REFERENCE TO RELATED APPLICATIONS

This application claims priority under 35 U.S.C. §119(e) to, and the benefit of, U.S. Provisional Patent Application No. 61/707,697, entitled "PROTECTIVE GARMENT WITH WIRE MESH," filed on Sep. 28, 2012, the entire disclosure of which is hereby incorporated by reference; and U.S. Provisional Patent Application No. 61/785,465, entitled "PROTECTIVE WIRE MESH GARMENT," filed on Mar. 14, 2013, the entire disclosure of which is hereby incorporated by reference.

FIELD OF THE INVENTION

The present invention generally relates to protective garments, such as gloves, arm guards, leg guards, foot guards, neck guards, torso guards, head guards, and other body part garments, that include wire mesh, and more particularly to protective garments with a wire mesh protective layer to provide cut, puncture, and abrasion resistance.

BACKGROUND OF THE INVENTION

It is common to wear a protective garment to guard a wearer against cuts, abrasions, and punctures to the skin covered by the protective garment. Protective garments frequently include more than one layer of fabric or material to increase the protective characteristics of the garment. Increased layers of fabric or material on a protective garment will typically increase rigidity and bulk of the garment and limit dexterity and function of the garment for the user.

SUMMARY OF THE INVENTION

According to one aspect of the present invention, a protective glove includes an inner liner having a soft pliable material configured to cover a front side and a back side of a user's hand. A protective layer is attached to an exterior surface of the inner liner and disposed over at least the front side of the user's hand. The protective layer includes a wire mesh panel that is configured to protect the user's hand from cuts, abrasions, and punctures and that has an edge portion with a plurality of wire ends. An edge protector is disposed over the edge portion of the wire mesh panel and substantially conceals the wire ends to prevent the edge portion from fraying and the plurality of wire ends from piercing the inner liner. An outer layer is attached to the exterior surface of the inner liner and is disposed over the protective layer.

According to another aspect of the present invention, a protective glove includes an inner liner having a fabric material configured to abut a skin surface of a user. A plurality of wire mesh panels is layered over a palm portion of the inner liner to protect the adjacent skin surface from cuts, abrasions, and punctures. The plurality of wire mesh panels has an edge portion with a plurality of wire ends. An edge protector covers the edge portion of the wire mesh panels to substantially conceal the plurality of wire ends and to prevent the edge portion from fraying. An outer layer is disposed over the plurality of wire mesh panels and has a stitching that extends thought the edge protector and the inner liner to attach the outer layer with the inner liner.

According to another aspect of the present invention, making a protective glove includes providing a fabric shell liner that has a fabric material configured to abut a skin surface of a user and sized to cover a front side and a back side of a user's hand. A plurality of wire mesh panels are also provided having an edge portion with a plurality of wire ends and a shape generally conforming to a periphery of the front side of the user's hand. An edge protector is attached to the edge portion of the plurality of wire mesh panels to substantially conceal the wire ends and to prevent the edge portion from fraying. The plurality of wire mesh panels is attached to the fabric shell liner, such that a palm portion of the plurality of wire mesh panels cover a palm area of the fabric shell liner and a finger portion of the plurality of wire mesh panels is shaped wrap over tips of a finger area of the fabric shell liner to protect the adjacent skin surface from cuts, abrasions, and punctures. An outer layer is attached over the plurality of wire mesh panels by stitching through the outer layer, the plurality of wire panels, and the fabric shell liner to attach the outer layer with the inner liner.

According to yet another aspect of the present invention, a glove includes an inner liner, a protective layer, and an outer layer. The inner liner has a soft pliable material configured to cover and abut a skin surface of a hand. The protective layer is disposed over a work surface of the inner liner and has a wire mesh panel. The wire mesh panel that includes an edge portion with a plurality of wire ends and a body portion configured to protect the skin surface from cuts, abrasions, and punctures. An edge protector is disposed on the edge portion of the wire mesh substantially concealing the plurality of wire ends. The edge protector is configured to prevent the edge portion from fraying and to prevent the skin surface from being pierced by the plurality of wire ends. The outer layer is disposed over the protective layer.

These and other features, advantages, and objects of the present invention will be further understood and appreciated by those skilled in the art by reference to the following specification, claims, and appended drawings.

DETAILED DESCRIPTION

Figure 1:
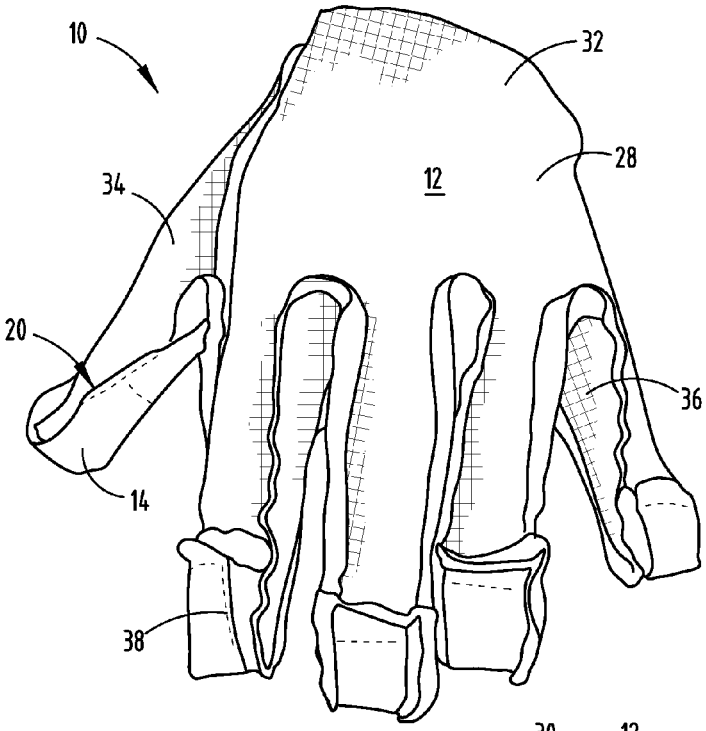
FIG. 1 is a top perspective view of a back side of an inner liner and a protective layer of a protective glove according to one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-12 reference numeral 10 generally designates a protective glove that has an inner liner 12, a protective layer 14, and an outer layer 16. The inner liner 12 includes a soft pliable material that is configured to abut a skin surface of a user. The protective layer 14 is attached to an exterior surface of the inner liner 12 and disposed over at least the front side of the user's hand. The protective layer 14 includes a wire mesh panel 18 that has an edge portion 20 with a plurality of wire ends 22 and a body portion 24 configured to protect the skin surface from cuts, abrasions, and punctures. An edge protector 26 is disposed on the edge portion 20 of the wire mesh substantially concealing the plurality of wire ends 22. The edge protector 26 is configured to prevent the edge portion 20 of the wire mesh panel 18 from fraying and to prevent the skin surface from being pierced by the plurality of wire ends 22. The outer layer 16 is disposed over the protective layer 14 and couples with the inner liner 12.

Figure 2:
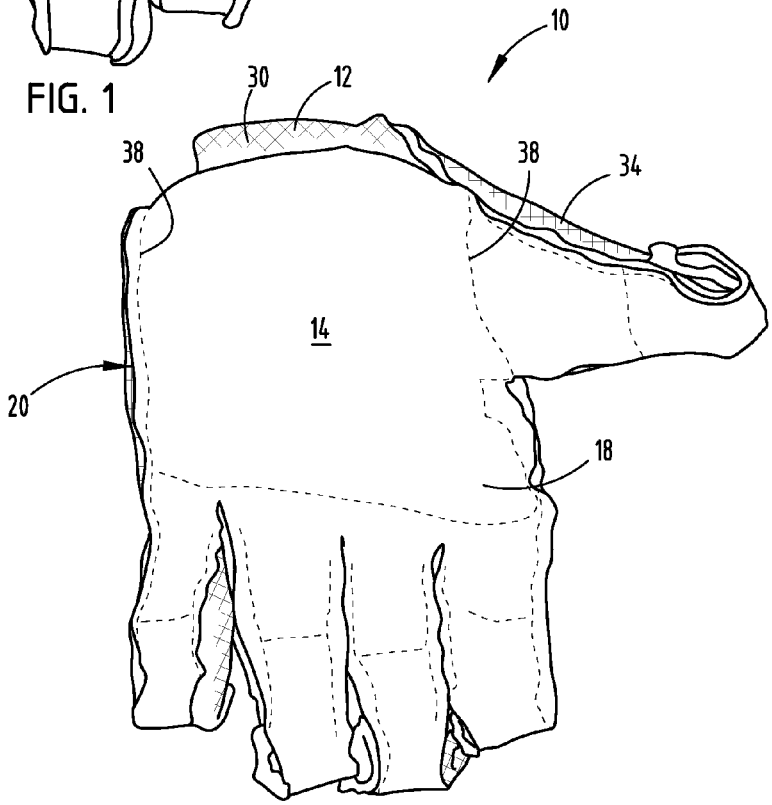
FIG. 2 is a top perspective view of a front side of the protective glove, illustrating a palm area of the protective glove.

As captured in FIGS. 1-2, a glove embodiment of the protective garment 10 is shown. The inner liner 12 includes a fabric shell 28 that substantially covers the entire hand. The fabric shell 28, as illustrated, is made of a front portion 30, a back portion 32, a thumb portion 34, and a webbing portion 36. The front portion 30 substantially covers a palm and a palm side of the fingers. The back portion 32 substantially covers a back side of the palm and fingers. The thumb portion 34 substantially covers an entire thumb and extends between the front portion 30 and the back portion 32. The webbing portion 36 substantially covers between the fingers and also extends between the front portion 30 and the back portion 32. The front portion 30 and the back portion 32 engage along both sides of the glove. It is understood to those skilled in the art that the portions of the fabric shell 28 may be integrally formed or further divided. In addition, the fabric shell 28 may be extended to a wrist area and an arm area and alternatively constructed to substantially cover other body areas, such as a foot, a leg, an arm, a neck, and a portion of a torso, or a combination thereof. Further, it is understood that although a left hand glove is shown, a substantially mirror image of the glove is imagined for a right hand glove.

The fabric shell 28, as shown in FIGS. 1-2, is assembled by sewing the front portion 30, back portion 32, thumb portion 34, and webbing portion 36 together, such that excess material at the seams therebetween extends to an outside surface of the fabric shell 28. Accordingly, an inside surface of the fabric shell 28 includes smooth seams and is configured to be against the skin surface of the user. It is conceivable that the fabric shell 28 or portions thereof may be additionally or alternatively joined or bonded with adhesive, fusible material, or other conceivable fasteners.

As illustrated in FIGS. 1-2, the inner liner 12 is shown constructed entirely with a polyester material. However, it is conceivable that a woven or non-woven material including a cotton material, nylon material, or a similar material or combination of materials may be used. The inner liner 12 may also include breathable, moisture wicking, or waterproof material or materials. As such, it is conceivable that alternative materials may be used for various portions of the fabric shell 28, as described above.

Still referring to FIGS. 1-2, the protective layer 14 is disposed over the fabric shell 28 of the inner liner 12, including the palm, the palm side of the fingers, a palm side and tip portion of the thumb, and a finger tip area extending between the back side of the fingers and the palm side of the fingers. It can also be described that the protective layer 14 is disposed over a work area of the fabric shell 28. It is understood that additional or fewer portions of the fabric shell 28 may be covered with the protective layer 14 or portions of the protective layer 14. In addition, it conceivable that other embodiments of the protective garment 10, such as an arm guard, may include the protective layer 14 disposed over portions or the entire inner liner 12.

As illustrated in FIGS. 1-2, the protective layer 14 is sewn to the inner liner 12. A stitching 38 is positioned along a periphery of the protective layer 14 with exception to a wrist edge of the palm. The stitching 38 is also positioned between the fingers and the palm and at an intermediate portion of the fingers. The stitching 38 is strategically placed to increase the flexibility and comfort of the glove. It is conceivable that the protective layer could be sewn or bonded to the inner liner 12, the outer layer 16, or both. It will be understood that the stitching or bonding pattern and quantity will be placed or applied to allow for increased flexibility, breathability and wearer comfort. It is also conceivable that the inner and outer layers 12, 16 could be sewn together with the protective layer 14 floating loose between the inner and outer layers 12, 16, allowing the protective layer 14 to float between the layers.

The protective layer 14 includes at least one wire mesh panel 18 disposed over the inner liner 12 to protect the skin surface of the user from cuts, abrasions, and punctures. The protective layer 14, as shown in FIGS. 1-2, includes six layers of wire mesh panels 18. However, it is conceivable that various layers of wire mesh panels 18 may be used in the protective layer 14, depending on the wire mesh panel 18 characteristics and intended use of the protective garment 10. For example, the number of layers the garment features will depend on the environment and potential hazards faced by the user wearing the garment and the required movement and pliability required by the garment. The protective layer 14 with at least one wire mesh panel 18, as shown and described, provides the user with cut, puncture, and abrasion resistance. According to one embodiment, two layers of the wire mesh panels 18 are provided in the protective layer 14.

According to another embodiment, six layers of wire mesh panels 18 are provided in the protective layer 14. It is conceivable that a wide range of layers of wire mesh panels 18 may be provided in the protective lay 14 and various amounts of layers of wire mesh panels 18 may be provided at different portions of the protective layer 14 and at different portions of the protective garment 10.

Figure 3:
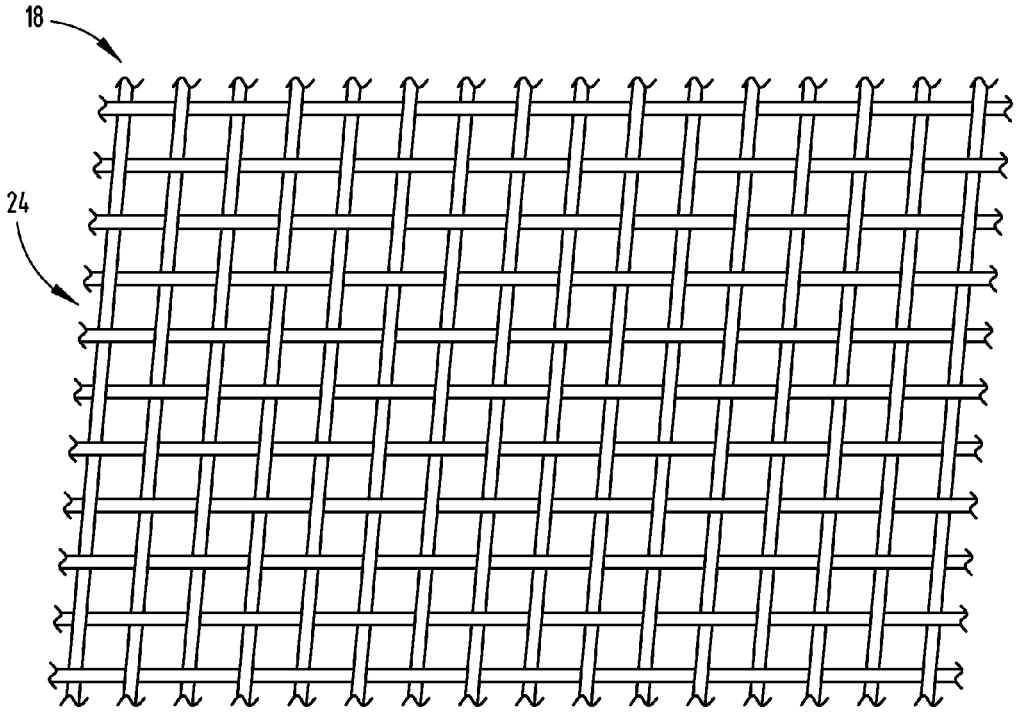
FIG. 3 is an enlarged top plan view of a body portion of the protective layer.
Figure 4:
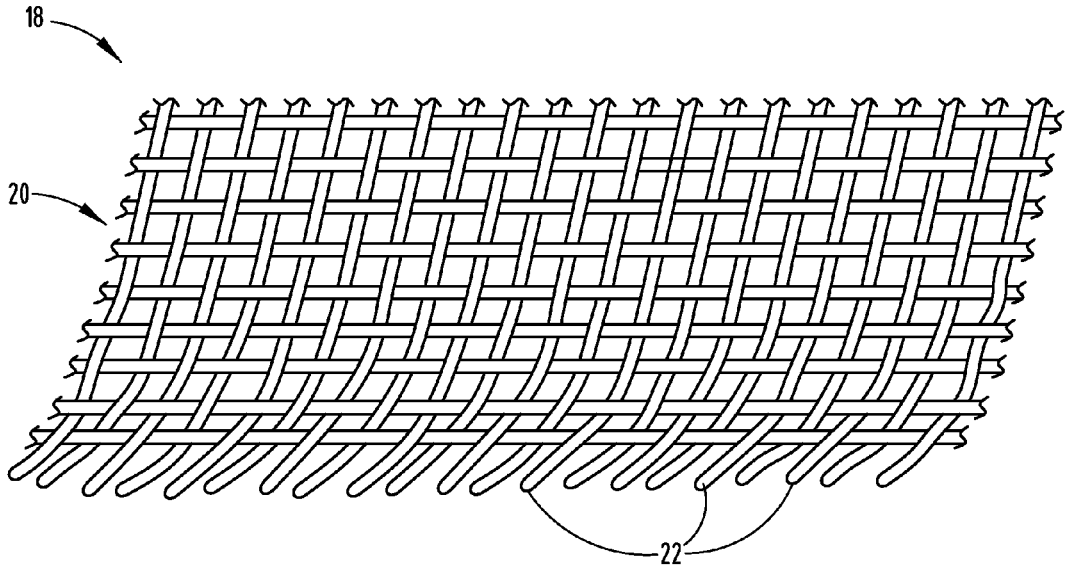
FIG. 4 is an enlarged top plan view of an edge portion of the protective layer.

Referring now to FIGS. 3-4, the wire mesh panel 18 is shown having a body portion 24 (FIG. 3) and an edge portion 20 (FIG. 4). The body portion 24 of the wire mesh panel 18 is configured to protect the skin surface from cuts, abrasions, and punctures. According to one embodiment, as illustrated, the body portion 24 of the wire mesh panel 18 is a plain weave with 250 mesh (wires per linear inch) and 0.0024 inch openings made with stainless steel wires of type T304 and diameter of 0.0016 inches. As also illustrated, the wire mesh panel 18 has a 36% open area and a 0.003 inch thickness, weighing 0.04 pounds per square inch. It is conceivable that for such a glove with a protective layer 14 using a plain weave wire mesh panel 18, the mesh count could vary at least from 100 mesh to 800 mesh (wires per linear inch) and the wire diameter could vary at least from 0.0005 inches to 0.004 inches. It is also conceivable that an embodiment may include a mesh or wire diameter outside the given ranges, which are simply provided to describe some potential ranges that may be used for some embodiments. Further, it is conceivable that a Dutch weave may be used having 8×40 weaves per inch to 300×2000 weaves per inch with a wire diameter between 0.0005 inches to 0.004 inches. The wire material may also or alternatively include other metals, including other types of non-corrosive stainless steel.

As shown in FIG. 4, the edge portion 20 of the wire mesh panel 18 has a plurality of wire ends 22. The wire ends 22 are angled due to deformation caused by shear force used to cut the wire mesh panel 18 to a pattern used for the protective layer 14. If the wire mesh panel 18 is directly applied to the protective garment 10, the wire ends 22 may fray and cause deterioration and wear to fabric of the inner liner 12 or outer layer 16 proximate the edge portion 20 of the wire mesh panel 18. In addition, the wire ends 22 may pierce through the inner liner 12 or outer layer 16 of the protective garment 10 and expose a user or others to the wire ends 22, which may scratch, poke, cut, or otherwise cause damage or an injury.

Figure 5:
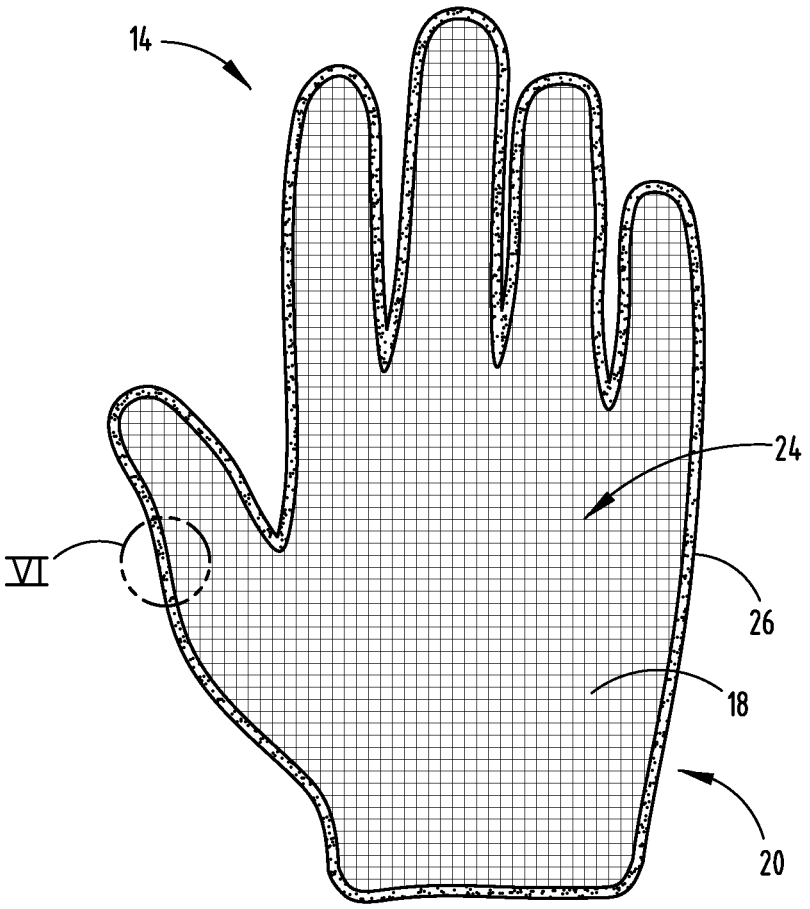
FIG. 5 is an top plan view of the edge portion of the protective layer having one embodiment of an edge protector applied to the edge portion.
Figure 6:
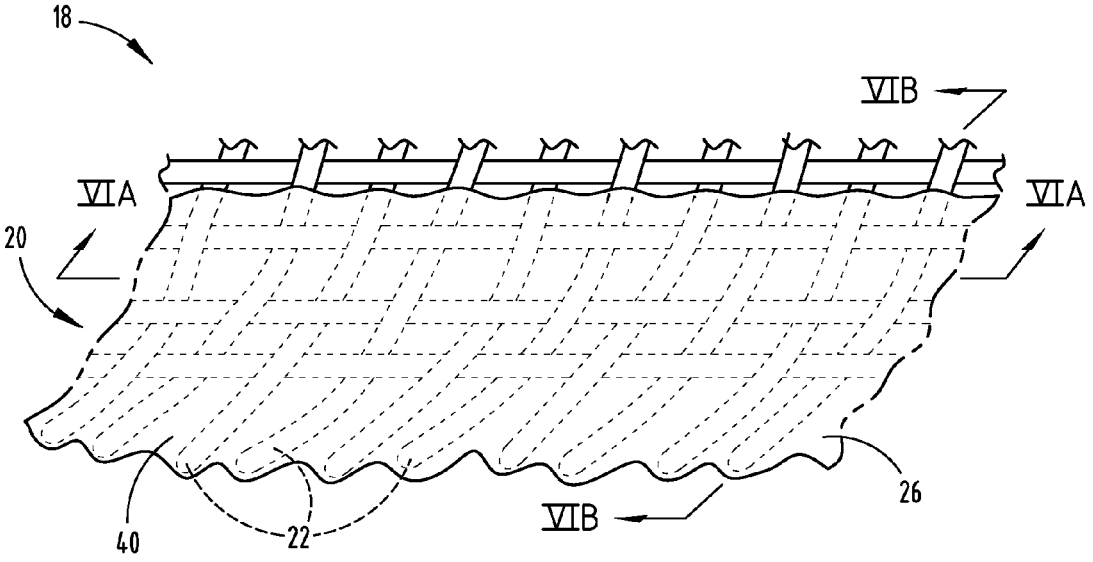
FIG. 6 is a sectional top plan view of the edge portion of the protective layer, taken from section VI of FIG. 5.
Figure 6A:
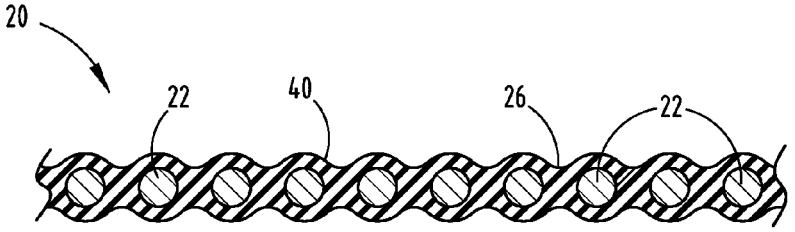
FIG. 6A is a cross-sectional view of the edge protector and the edge portion, taken at line VIA-VIA of FIG. 6.
Figure 6B:
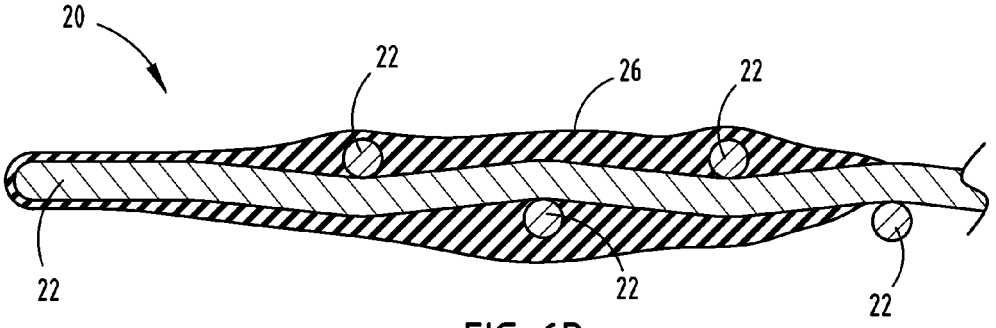
FIG. 6B is a cross-sectional view of the edge protector and the edge portion, taken at line VIB-VIB of FIG. 6.

As illustrated in FIGS. 5-6B and 10-11, the edge protector 26 is disposed on the edge portion 20 of the wire mesh panel 18 substantially concealing the wire ends 22. The edge protector 26 is configured to prevent the edge portion 20 from fraying and to prevent the user and others from being pierced or otherwise injured by the wire ends 22. The edge protector 26 shown in FIGS. 5-6B is an polymeric coating 40 that is applied to an approximately 1-10 mm area of the edge portion 20 of the wire mesh panel 18 using a screen printing process. As shown, the coating 40 bonds to and extends between the wire ends 22 to create a substantially solid edge that is less likely to pierce through the inner or outer layers 12, 16 of the protective garment 10. The polymeric coating 40 may include rubber, silicon, nitrile, polyvinyl chloride (PVC), similar materials, or combinations thereof. In addition, it is conceived that other methods of applying the coating 40 to the edge portion 20 may include dipping the edge portion 20 in a bath of the polymeric material or spraying the polymeric material on the edge portion 20.

Figure 7:
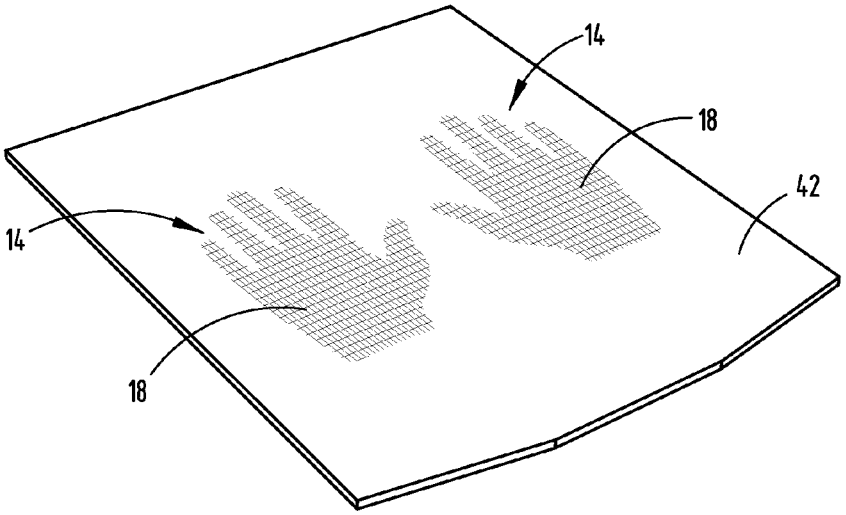
FIG. 7 is a top perspective view of a platform having a pair of wire mesh protective layers positioned to receive polymeric coating from a screen printing process.
Figure 8:
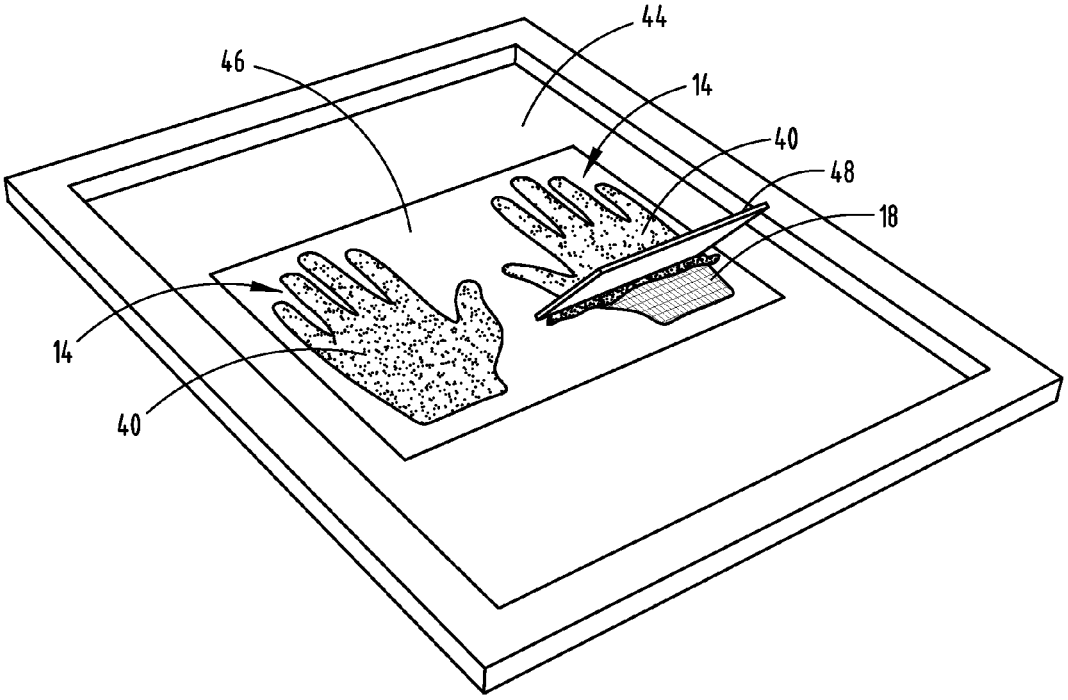
FIG. 8 is a top perspective view of the polymeric coating being screen printed to the wire mesh protective layers shown in FIG. 7, according to one embodiment of the screen printing process.

As shown in FIGS. 7-8, the screen printing process is partially illustrated. After the wire mesh panel 18 is cut to correlate with the pattern used for the protective layer 14, the wire mesh panel 18 is aligned on a flat surface 42, shown as a pair of wire mesh panels in the shape of hands on an alignment board in FIG. 7. A print film 44 is then placed over the wire mesh panel 18, as shown in FIG. 8. The print film 44 has a screen build-in 46 with an area allowing the coating 40 material to go through the screen 46. The area of the screen build-in 46 is in a pattern representing the edge portion 20 of the wire mesh panel 18, which may be the entire wire mesh panel, as illustrated, or only the edge portion 20, which is approximately 2-3 mm area proximate the wire ends 22. When the print film 44 is properly aligned over the wire mesh panels 18 the operator then applies a coating 40 by pulling the coating material over the screen build-in 46 with a tool 48 that is similar to a squeegee. The operator then lifts the print film 44 and then places the wire mesh panel 18 into an oven for curing. After the coating 40 has cured the wire mesh panel 18 is sewn or otherwise attached to the protective glove 10. It is also conceivable that the opposing side of the wire mesh panel 18 may be screen printed with the coating 40 after the initial coating 40 has cured. In addition, it is conceived that multiple layers of the wire mesh panels 18 may be coated in single application using screen printing.

The coating material may also be applied to the wire mesh panel 18 by dipping the wire mesh panel 18 in a bath of a substantially liquid state of the coating material or spreading the substantially liquid coating material over the mesh panel. The coating material may include rubber, silicon, nitrile, latex, polyurethane, neoprene, hydrogels, acrylins, polyvinyl chloride (PVC), similar materials, or combinations thereof. Such an application of the coating material may be applied to one or both sides of the edge portion 20 or an entire wire mesh panel 18, including the edge and body portions 20, 24. Dipping or spreading the coating material to the edge portion 20 similarly covers the wire ends 22 to prevent the edge portion 20 from fraying and to prevent the user and others from being pierced or otherwise injured by the wire ends 22.

Figure 9:
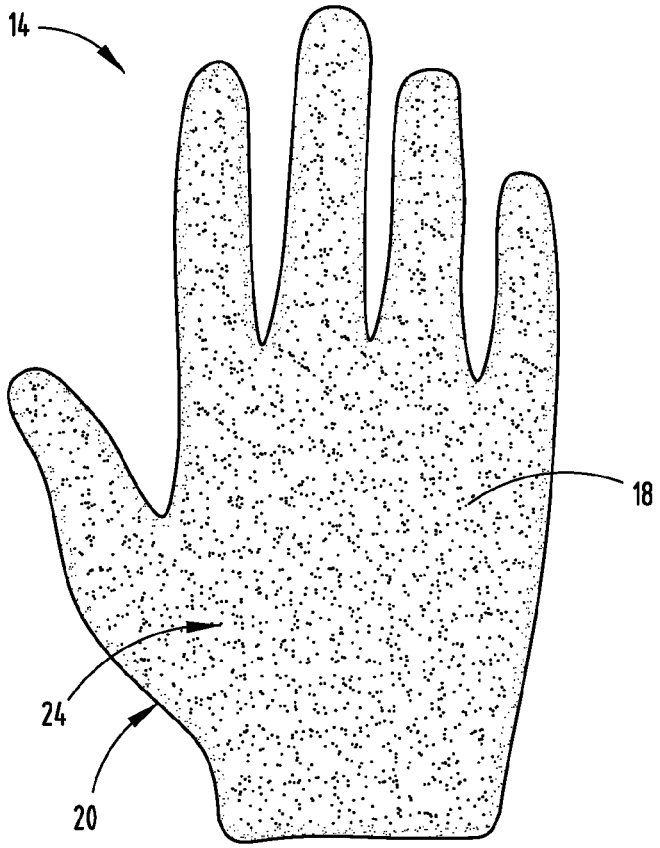
FIG. 9 is a top plan view of one embodiment of the protective layer having an entire surface coating.
Figure 10:
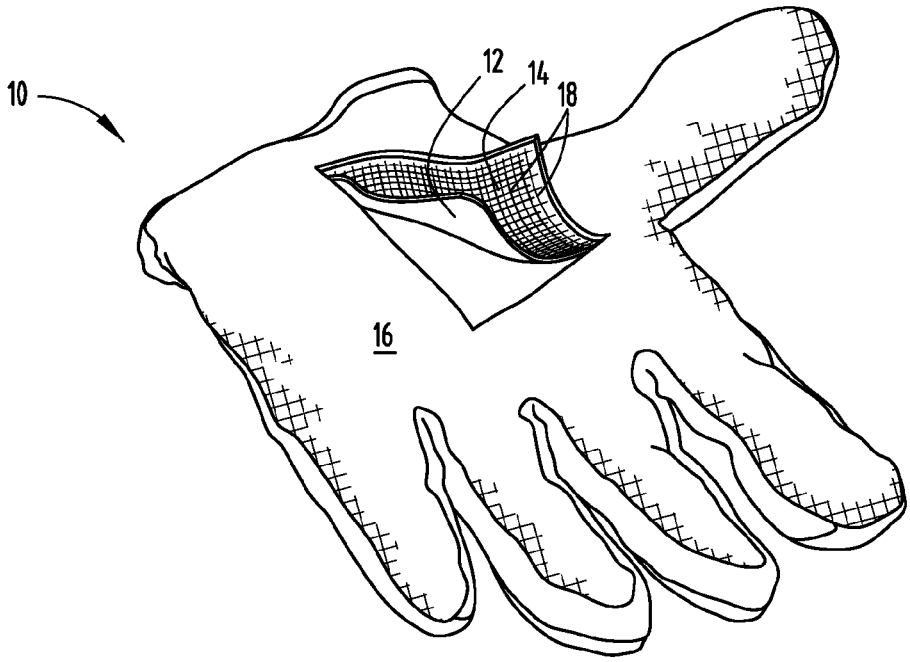
FIG. 10 is top perspective view of a front side of a protective glove having an outer layer and a portion cut away on the palm area to show the protective layer and the inner liner, according to one embodiment of the present invention.
Figure 11:
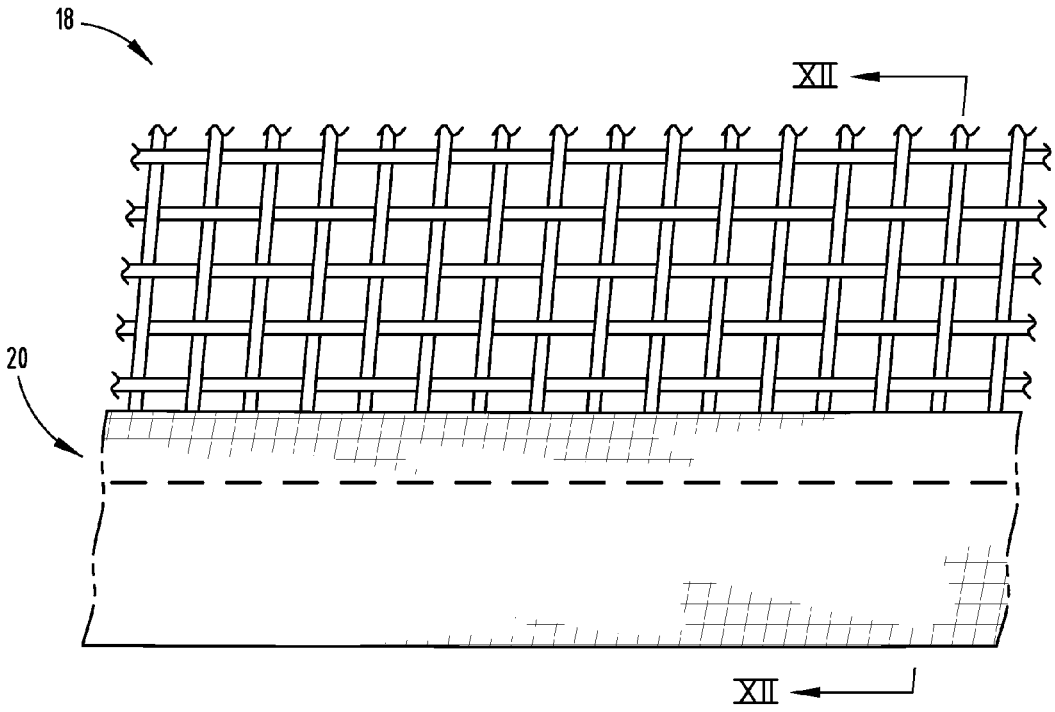
FIG. 11 is an enlarged top plan view of the edge portion of the protective layer having another embodiment of the edge protector.

As illustrated in FIG. 9, the entire wire mesh panel 18 is coated with the coating material before being sewn or otherwise attached to the protective garment 10. More specifically, the wire mesh panel 18 as shown in FIG. 9 is configured to cover the palm of the inner liner 12. It is conceivable that the coated wire mesh panel 18 or variations thereof may be sewn in high injury risk areas and applied over portions of the outer layer 16 for added protection. Applying the polymeric coating to the entire surface of the wire mesh panel 18 prevents it from bending beyond elastic deformation and adds resiliency to the wire mesh panel 18, such that plastic deformation causing folds or memory bends in the wire mesh panel 18 is substantially reduced. Notably, folds or memory bends in the palm and finger area may create bulk to the glove and limit dexterity of the user, such that adding the polymeric coating to the wire mesh panels 18 in the palm and finger area or other portions of the wire mesh panels 18 will decrease the occurrence and severity of the folds. Applying the polymeric coating to the wire mesh panel 18 also prevents electrical and heat conductivity and electrostatic charges by acting as an insulator. An additional advantage to including the polymeric coating around the plurality of layers of wire mesh panels 18 is to decrease the wear and friction caused between the wire mesh panels 18, such that any metal dust or metal particles created by degradation of wire mesh panels wearing against each other is substantially reduced. Accordingly, this formation of metal dust and metal particles is substantially eliminated or contained between wire mesh panels having polymeric coating disposed on at least one of the wire mesh panels on the surface abutting the opposing wire mesh panel. The polymeric coating in additional to the inner liner 12 further provides a barrier between the user's hand and any metal dust or metal created between layers of wire mesh panels 18.

Other conceivable methods of preventing punctures from the wire ends 22 and containment of any particulation that accumulates from friction between layers of the wire mesh panels, includes silicon printing on the mesh panel or panels, dipping and coating the mesh panel or panels, binding the mesh panel or panels as described below, spraying a polymer on the mesh panel or panels, powder coating the mesh panel or panels, encapsulating the mesh panel or panels in a bag or pouch, laminating a film on one side of the mesh panel or panels, laminating a film on both sides of the mesh panel or panels to create a pouch, shrink wrap the mesh panel or panels, heat seal the mesh panel or panels. The film would likely include a soft film or a thermoplastic film.

The coating material may be applied to a sheet of wire mesh that is then cut into panels 18 and may be applied to individual wire mesh panels 18. In addition, it is conceived that multiple layers of the wire mesh panels 18 may be coated in single application using the dipping or spreading process, such that the coating material acts as an adhesive between the wire mesh layers, holding them in place to stop relative movement therebetween. It is also conceivable that multiple entirely-coated wire mesh panels 18 are layered to form the protective layer 14 or a portion thereof, which would have increased friction between inner and outer layers 12, 16 created by the coating material to allow for a more precise grip.

Figure 12:
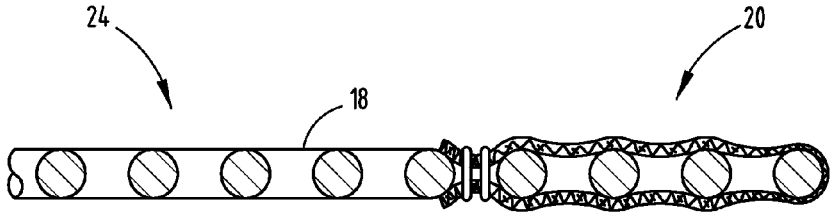
FIG. 12 is a cross-sectional view of the edge portion and the edge protector taken at line XII-XII of FIG. 12.

In the embodiment illustrated in FIG. 12, the inner liner 12, protective layer 14, and outer layer 16 are shown in a cutaway view. In the illustrated embodiment, the inner liner 12 is made of polyester, the protective layer 14 includes six layers of wire mesh panels 18, and the outer layer 16 is made of synthetic leather. The six layers of wire mesh panels 18 are first sewn or otherwise joined together through the protective edge and then sewn or otherwise joined to the inner liner 12. Alternatively, the protective layer 14 may be sewn or otherwise joined through the body portion 24 of wire mesh panels 18. The outer and inner liners 16, 12 are then sewn or otherwise joined together along the sides of the glove and between the fingers. It is also conceivable in this embodiment that the protective layer 14 is floating loose between the inner and outer layers 12, 16 to increase flexibility and comfort of the glove. In other embodiments, the inner liner 12, protective layer 14, and outer layer 16 may be joined by adhesive, polymer, heat bonding, or other forms of joining the layers or portions thereof.

Referring now to FIGS. 13-14, an additional embodiment of the edge protector 26 is shown having a binding 50 wrapping over the wire ends 22 of the edge portion 20 from a first side of the wire mesh panel 18 to a second side of the wire mesh panel 18. The binding 50 is sewn to couple a first portion 52 contacting the first side of the wire mesh panel 18 with a second portion 54 contacting the second side of the wire mesh panel 18, concealing the wire ends 22 between the first and second portions 52, 54 of the binding 50. As illustrated, the stitching is in alignment with the edge portion 20. The material of the binding 50 is configured to prevent the wire ends 22 from piercing through the inner liner 12 or outer layer 16 of the protective garment 10 and from exposing a user or others to the wire ends 22, which may scratch, poke, cut, or otherwise cause damage or an injury. The binding material may include cotton, spandex, polyester, polyurethane, and other pliable materials or combinations thereof having the described characteristics. It is conceived that this edge protector 26 embodiment can also be used for one or more layers of wire mesh panels 18.

In an additional embodiment shown in FIGS. 13-14, the edge portion of the wire mesh panels may be sanded or ground down to substantially reduce or eliminate the wire ends. Sanding or grinding the wire ends may also prevent the edge portion 20 from fraying and prevent the user and others from being pierced or otherwise injured by the wire ends 22. In such an embodiment, the edge protector, such as the binding or coating, may not be necessary.

As also shown in FIGS. 13-14, the glove embodiment of the protective garment 10 is shown having the outer layer 16 disposed over the protective layer 14 and the inner liner 12. It is understood that the edge protector 26, including the coating 40 and the binding 50, may be sewn through to attach the wire mesh panel 18 to the inner liner 12 or outer layer 16 of the protective garment 10. As shown in FIG. 12, the outer layer 16 is then attached to the protective garment 10, covering the protective layer 14 and coupling with the inner liner 12. The outer layer 16 serves as a protective cover for the protective layer 14 and portions of the inner liner 12. Specifically, the outer layer 16 is shown as a synthetic leather, which provides abrasion resistance to improve longevity of the garment 10. It is conceivable that the outer layer 16 may also or alternatively include leather, nylon, polyester, cotton, nitrile, polyurethane, polyvinyl chloride (PVC), rubber, latex, silicon, polypropylene, Kevlar, and polyethylene, such that the outer layer 16 may also provide breathability, grip enhancement, waterproofing, water resistance, and chemical resistance. Additional components could also be added to the material for performance based texture, such as rubber pieces, sand, or foaming agents.

It will be understood by one having ordinary skill in the art that construction of the described invention and other components is not limited to any specific material or process. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A protective glove comprising:

a front side and a back side and a peripheral edge disposed therebetween;

an inner liner having a soft pliable material configured to extend across the front side and the back side;

a protective layer attached to an exterior surface of the inner liner and disposed over at least the front side, the protective layer comprising:

a wire mesh panel configured to protect from cuts, abrasions, and punctures through said protective glove, the wire mesh panel having an edge portion with a plurality of wire ends;

an edge protector disposed over the edge portion of the wire mesh panel at the peripheral edge defined between the front side and the back side, the edge protector substantially concealing the wire ends to prevent the edge portion from fraying and the plurality of wire ends from piercing the inner liner; and an outer layer attached to the exterior surface of the inner liner and disposed over the protective layer.

2. The protective glove of claim 1, further comprising:

a palm area and a finger area, and wherein the wire mesh panel is shaped to have finger portions that conform to the finger area.

3. The protective glove of claim 2, wherein finger portions of the wire mesh panel wrap over tips of the finger area and engage a back side of the finger area.

4. The protective glove of claim 1, wherein the edge protector includes a polymeric coating, and wherein the polymeric coating bonds to and extends between the wire ends to define a substantially solid edge along the wire mesh panel.

5. The protective glove of claim 4, wherein the polymeric coating includes at least one of rubber, silicon, nitrile, and polyvinyl chloride (PVC).

6. The protective glove of claim 1, wherein the outer layer includes a fabric material that is attached to the inner liner with a stitching that extends through the wire mesh panel.

7. The protective glove of claim 1, wherein the outer layer includes a polymeric coating disposed over the wire mesh panel and a portion of the exterior surface of the inner layer to provide added puncture resistance to the protective layer.

8. The protective glove of claim 1, wherein the wire mesh panel includes at least two sheets of overlapping wire mesh that are both attached to the inner liner.

9. A protective glove comprising:

an inner liner having a fabric material configured to abut a skin surface of a user and including a palm area and finger portions extending therefrom;

wire mesh panels layered over a palm portion of the inner liner to protect the adjacent skin surface from cuts, abrasions, and punctures and having an edge portion with a plurality of wire ends;

an edge protector extending between finger portions of the inner liner and covering the edge portion of the wire mesh panels to substantially conceal the plurality of wire ends and to prevent the edge portion from fraying; and an outer layer disposed over the plurality of wire mesh panels and having a stitching that extends thought the edge protector and the inner liner to attach the outer layer with the inner liner.

10. The protective glove of claim 9, wherein the mesh panels are shaped to have finger portions that are sized to cover a front surface of the finger portions of the inner liner.

11. The protective glove of claim 10, wherein the finger portions wrap over tips of the finger area and engage a back surface of the finger area.

12. The protective glove of claim 9, wherein the edge protector includes a polymeric coating, and wherein the polymeric coating bonds to and extends between the wire ends to define a substantially solid edge along the plurality of wire mesh panels.

13. The protective glove of claim 12, wherein the polymeric coating of the edge protector includes polyvinyl chloride (PVC).

14. The protective glove of claim 9, wherein the outer layer conceals the entire inner layer and is attached directly to the inner layer around a wrist opening.

15. The protective glove of claim 9, wherein the plurality of wire mesh panels include less than 6 wire mesh panels overlapping at any single location.

16. The protective glove of claim 15, wherein the plurality of wire mesh panels each are constructed with wires having a diameter less than 0.004 inches.

17. The protective glove of claim 9, wherein the outer layer includes a polymeric coating disposed over the plurality of wire mesh panels and at least a portion of the exterior surface of the inner layer to provide added puncture resistance and increased resiliency to an exterior panel of the plurality of wire mesh panels.

* * * * *